US005339465A

United States Patent [19]

Kyewski

[11] Patent Number: 5,339,465

[45] Date of Patent: Aug. 23, 1994

[54] PALM GUARD FOR SPORTS

[76] Inventor: Ronald A. Kyewski, 234 Bonita La., Foster City, Calif. 94404

[21] Appl. No.: 13,002

[22] Filed: Feb. 3, 1993

[51] Int. Cl.[5] ..... A41D 13/00; A47J 45/10

[52] U.S. Cl. ..... 2/20; 2/161.1

[58] Field of Search ..... 2/159, 160, 161 R, 161 A, 2/16, 20, 161.1, 161.2; 30/324, 328; 294/7, 8.5, 54.5, 55; 602/60, 61, 62, 64, 66

[56] References Cited

U.S. PATENT DOCUMENTS

| | | | |
|---|---|---|---|
| Re. 32,566 | 12/1987 | Patton, Jr. | 2/161 A |
| 1,377,103 | 5/1921 | Suhr | 2/20 X |
| 1,469,315 | 10/1923 | Hansard | 2/161 A |
| 3,496,573 | 2/1970 | Kuchar et al. | 2/16 X |
| 3,772,706 | 11/1973 | Brigidi | 2/161 A |
| 4,011,596 | 3/1977 | Chang | 2/16 |
| 4,047,250 | 9/1977 | Norman | 2/16 X |

*Primary Examiner*—Clifford D. Crowder
*Assistant Examiner*—Gloria Hale
*Attorney, Agent, or Firm*—James E. Eakin; Janet Kaiser Castaneda

[57] ABSTRACT

A rigid, molded unitary palm guard, with shock absorption and dissipation properties protects the palm and the wrist of the wearer when incorporated into the palm area of a glove for roller skating, in-line skating, skateboarding, snakeboarding and the like. The guard is generally rectangular in shape with rounded comers and edges and defines an arched palm portion and a wrist portion. The arch of the palm portion forms a space between the palm of the hand and the guard, and in conjunction with the width of the palm portion, enables impact protection for the side of the palm of the hand as well as for the central area of the palm and the wrist. The outermost edge of the palm portion defines a first thickness, the apex of the arch defines a second and greater thickness, and the outermost edge of the wrist portion defines a third thickness. The guard cups the palm area thereby enabling the arched palm portion to be impacted in the event of a fall. A wrist wrap holds the wrist portion of the guard in place and further assists in preventing hyperextension of the wrist.

10 Claims, 2 Drawing Sheets

PALM GUARD FOR SPORTS

The present invention relates to guards for sports. More particularly, the invention relates to a unitary palm guard that protects both the palm of the hand and the wrist, preferably for insertion into a glove worn while roller skating, in-line skating, skateboarding, and snakeboarding.

BACKGROUND OF THE INVENTION

Palm guards and wrist guards are known in the art for use in sports activities to protect a participant's hand and wrist from injury. Such guards are commonly used in roller skating, in-line skating, skateboarding, and snakeboarding to protect the hand and wrist area when a participant happens to fall and his/her hand or wrist impacts the unforgiving playing surfaces commonly associated with such sports.

The guards used in such sports are generally designed with goals of preventing abrasions and more serious injury to the hand and wrist area, cushioning the palm against impact from a fall, and preventing hyperextension of the wrist upon impact.

The prior art guards for skating, skateboarding and the like found on the market today generally include two major protective components: a first narrow, splint-like palm component for placement on the palm of the hand and a second narrow, splint-like wrist component placed on the back of the hand. The two components are generally incorporated into a protector commonly referred to as a wrist guard, or the components may be incorporated into an abbreviated glove having the finger portion covering only the upper phalange of each finger.

The palm component generally is an elongated, narrow splint-like element extending from the palm of the hand to above the wrist thereby providing little or no protection for the sides of the palm of the hand and for the base of the thumb. Such palm guards may be constructed from a soft substance to pad the palm area, or they may be made from a semi-rigid or rigid material. The wrist component is typically made from a semi-rigid or rigid material, and it is incorporated into the back of the hand portion of the wrist guard or glove. The wrist component is generally also an elongated, narrow splint-like element typically extending from the mid-portion of the back of the hand to approximately two inches above the wrist thereby preventing extension of the hand. Fasteners may also be provided to tighten and secure the glove to the hand.

Skating and skateboarding participants may not wear the available protective wrist guards or gloves for a variety of reasons. Some users report that the available gloves restrict freedom of movement of the hand, particularly the wrist component, and such gloves may be bulky and/or hot to wear comfortably. The padding or device used to protect the palm area, in conjunction with the wrist component on the back of the hand, often does not allow effective heat dissipation. The prior art wrist guards and protective gloves place the user's hand and wrist between two splints thereby effectively preventing up and down flexure of the wrist.

In addition to the problems cited above, when worn, the available protective gloves may not provide adequate protection to the wearer. The available palm guards for in-line skating and the like are generally too narrow to protect against impact or shock to the sides of the palm and the heel of the hand, particularly to the base of the thumb in the heel area of the hand.

SUMMARY OF THE INVENTION WITH OBJECTS

A general object of the present invention is to provide a palm guard that overcomes the limitations and drawbacks of the prior art.

A more specific object of the present invention is to provide an inexpensive palm guard for incorporation into, or removable insertion into, protective hand gear for sports.

Another specific object of the present invention is to provide a palm guard that prevents impact from a fall to the palm of the hand, the heel of the hand, the side of the hand, and the inner wrist.

One more specific object of the present invention is to provide a palm guard of sufficient width and length to, in conjunction with a wrist wrap, protect against hyperextension of the wrist without need for a wrist guard on the top of the back of the hand.

Yet another specific object of the present invention is to provide a palm guard made from a strong plastic material and shaped to absorb and dissipate impact energy.

Still another specific object of the present invention is to provide a lightweight palm guard for a protective glove for roller skating, in-line skating, skateboarding, and snakeboarding.

A palm guard preferably molded from a strong, rigid material with shock absorption properties defines an elongated, generally rectangular shape with rounded corners and edges. The longitudinal axis of the palm guard is parallel to the longitudinal axis of the hand. The palm guard defines an arched palm portion and a wrist portion.

The arch of the palm portion, in conjunction with the width of the palm portion, enables impact protection for the side of the palm of the hand as well as for the central area of the palm. The outermost edge of the palm portion nearest the phalanges defines a first thickness. The thickness in the arch of the palm portion increases from the outer edge inwardly to a maximum thickness at the rounded apex of the arch. When the palm guard is incorporated into a glove, there is preferably a space between the arched palm portion and the palm of the hand thereby cupping the palm guard over the palm and heel of the hand to enable the arched palm portion to be impacted in the event of a fall.

From the apex of the arch, the palm portion extends into the contiguous wrist portion and the thickness of the palm guard decreases. The wrist portion is slightly narrower than the palm portion, following the shape of the wrist, and the outer edge of the wrist portion is preferably thinner than the outer edge of the palm portion.

The arched palm portion preferably covers the majority of the palm of the hand, and the wrist portion extends at least one inch, preferably more, above the juncture between the inner wrist and the hand.

The palm guard is preferably placed within a pocket of a glove for roller skating, in-line skating and the like. The preferred glove includes a wrist wrap to support the wrist portion and to prevent hyperextension of the hand.

These and other objects, advantages and features of the present invention will become more apparent upon considering the following detailed description of a preferred embodiment, presented in conjunction with the accompanying drawings.

DETAILED DESCRIPTION OF A PREFERRED EMBODIMENT

Figure 4:
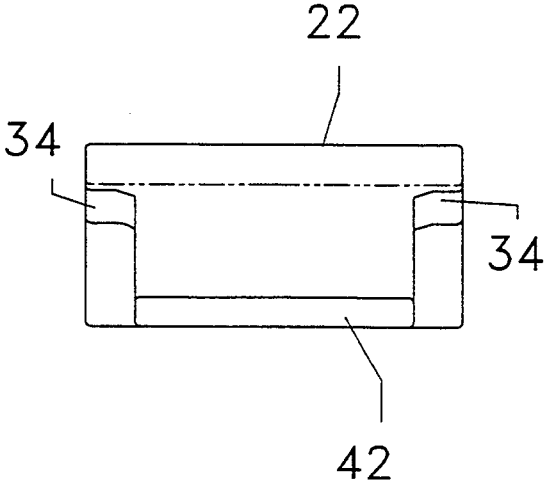
FIG. 4 is an end view showing the rounded, curved edges of the palm guard.

Referring to the figures, a palm guard embodying the principles of the present invention is shown generally as reference numeral 10. The guard 10 is preferably molded from a strong, rigid plastic material having abrasion resistant properties and a high strength to weight ratio. Preferred materials include a polyamide plastic material such as nylon 6/6, Zytel® ST 801 nylon resin, and Zytel® 101 nylon resin. Preferred minimum specifications for materials are as follows: ultimate tensile strength 9,4000 psi; compressive deflective-strength 12,000 psi; tensile modulus of elasticity 320,000; tensile impact strength 75–180 ft/lb/in$^2$; flexure strength 12,500–14,000 psi; flexure modulus of elasticity 175,000–410,000 psi; shear strength 9,600 psi; coefficient of friction 0.17–0.43; and Rockwell hardness of R110–121. It will be recognized by those skilled in the art that other plastics having similar properties and of similar strength may also be used, such as ABS plastics, and that composite materials may also be suitable. All surfaces and edges are rounded and smoothed, as best seen in FIG. 4.

Figure 1:
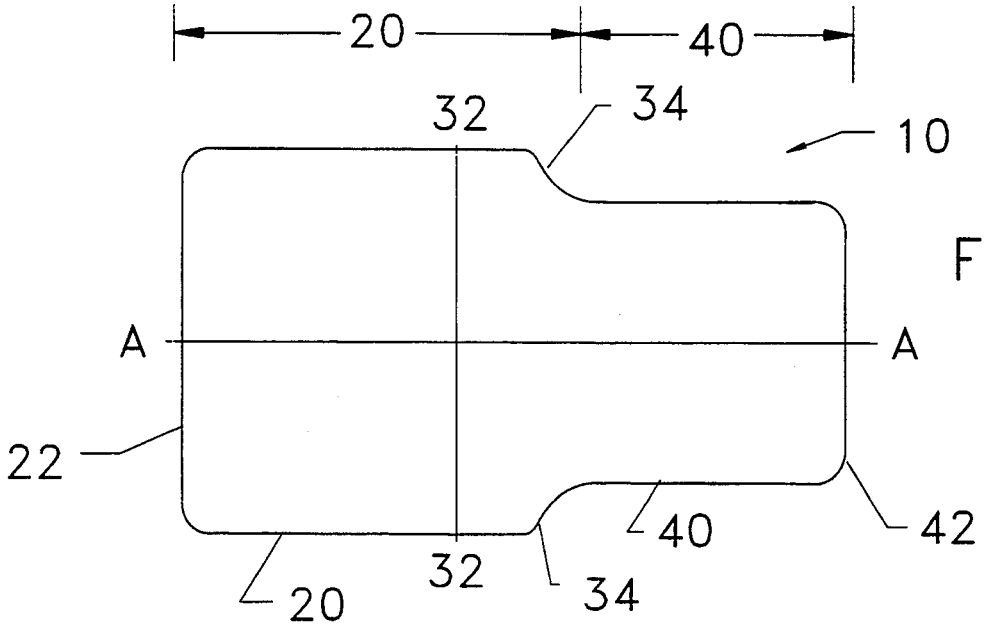
FIG. 1 is a top view of a palm guard embodying the principles of the present invention.
Figure 2:
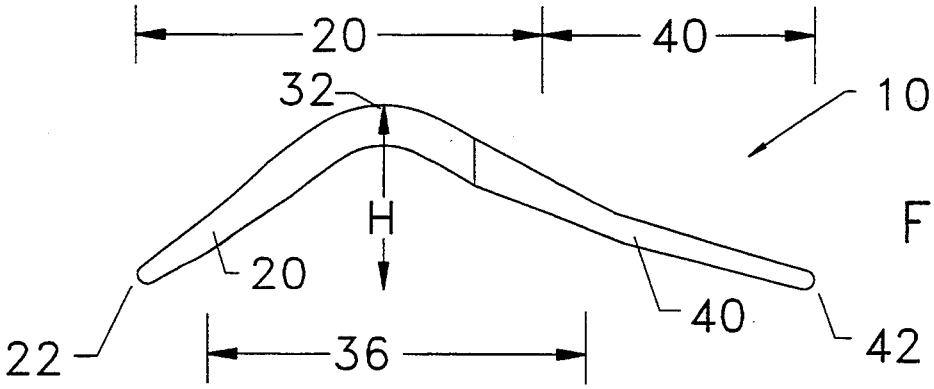
FIG. 2 is a side view of the palm guard of FIG. 1 showing the arch and the variations in thickness of the guard.

Referring now to FIGS. 1 and 2, the palm guard 10 defines an elongated, generally rectangular shape with rounded corners and edges, and includes an arched palm portion 20 contiguous with a wrist portion 40. The longitudinal axis "A" of the guard 10 is parallel to the longitudinal axis of the hand.

For considerations of comfort, wearability, mobility, and adequate protection, the preferred guard 10 is configured and positioned in a glove 2, shown in FIG. 3, so that the outermost edge 22 of the arched palm portion 20 lies approximately 0.5 inches below the juncture between the base of the middle finger and the palm of the hand, or approximately where the palm of the hand bends at the knuckles. In the preferred configuration, the edge 22 preferably extends laterally to cover all but approximately 0.5 inches ±0.25 inches, on each side of the palm of the hand.

The generally square arched palm portion 20 extends laterally across most of the palm of the hand to, in conjunction with the arch, enable impact protection to the side of the palm of the hand as well as to the distal, middle, and proximal area of the palm.

As best seen in FIG. 2, from the edge 22, the palm portion curves upwardly and outwardly from the surface of the palm of the hand to the apex 32 of the arch to form a rounded convex dome area 36 over the palm and the heel of the hand thereby creating a space between the palm of the hand and the palm guard 10. The thickness of the plastic in the arched palm portion 20 increases to a maximum thickness at the apex 32. It will be seen by those skilled in the art that, upon impact from a fall, the outwardly extending curved apex portion 32 is positioned for first impact with the playing surface. The plastic material of the palm guard 10 thereby absorbs and dissipates the shock of the impact. The space between the palm guard 10 and the palm of the hand prevents shock and impact to the hand. The convex dome area 36 and the width of the palm guard 10 ensure that the guard 10 absorbs impact, or at the least, deflects impact to the side or the distal area of the palm of the hand.

Referring now to FIGS. 1 and 4, from the apex 32, the guard curves inwardly, following the curve of the hand where the heel of the hand meets the wrist, to define a rounded shoulder edge 34 contiguous with the narrower wrist portion 40.

The outer edge 42 of the wrist portion is preferably the thinnest portion of the palm guard 10. The edge 42 extends at least 1.0 to 2 inches above the area where the heel of the hand joins the wrist.

The preferred palm guard 10 for adult use is 4.25 inches in length, 2.28 inches at its maximum width at edge 22, and 1.74 inches in width at edge 42. As best shown in FIG. 2, the arched palm portion curves upwardly to a height "H" of preferably 1.12 inches at the apex 32. The palm guard varies in thickness having a preferred thickness of 0.12 inches at edge 42, a maximum thickness of 0.25 inches at the apex 32 of the curved arch, and 0.18 inches at edge 22. Manufacturing tolerance for the width is approximately ±0.09 inches. Manufacturing tolerance for the linear dimension is approximately ±0.12 inches. The above dimensions are provided for a preferred embodiment and are not meant to be limited thereto. It will be recognized by those skilled in the art that other dimensions may be used to protect the areas of the hand and wrist described, and that the guard may be customized to protect a child's hand or a extra large hand.

Figure 3:
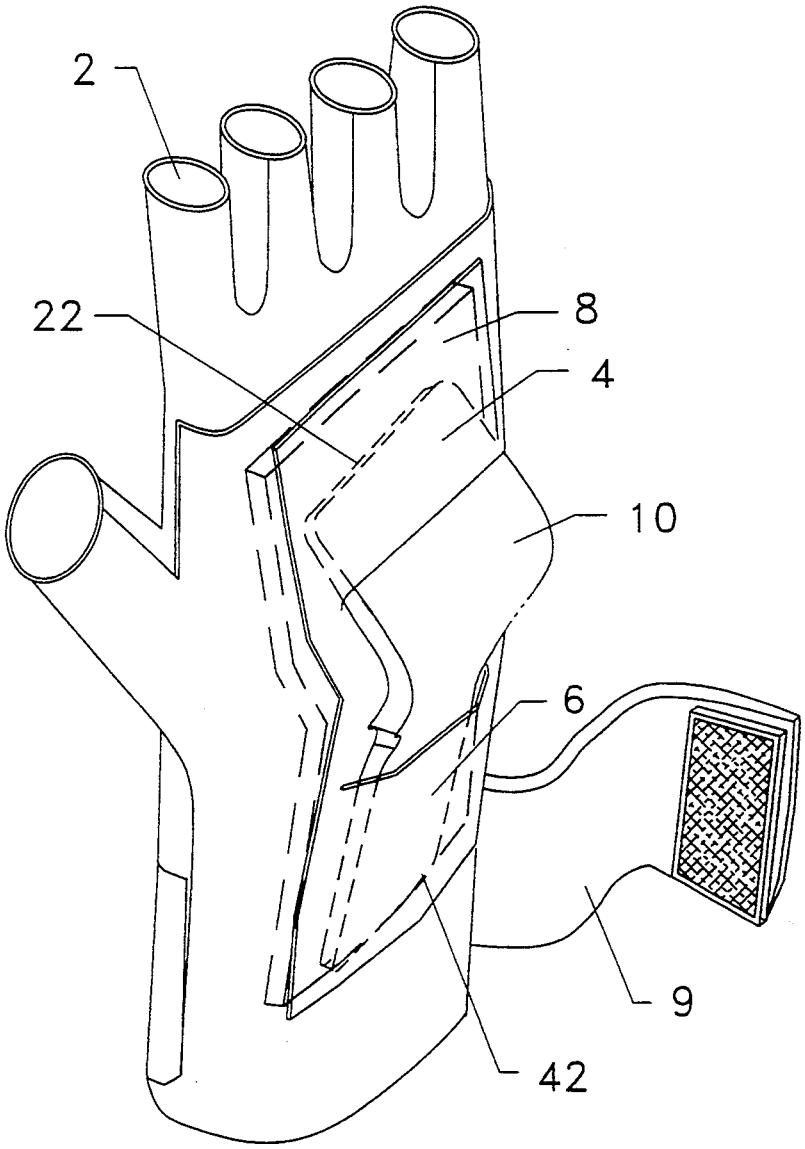
FIG. 3 is an abbreviated glove showing the palm guard of FIG. 1 inserted into packets formed in the palm area.

Referring now to FIG. 3, the guard 10 is shown positioned in an abbreviated sports glove 2 preferably made from a stretchable elastic material such as Lycra TM or spandex. The glove 2 includes a preferably leather or suede palm guard holder 8 suitably attached to the glove 2. The palm guard holder 8 defines a pair of pockets 4,6 for insertion of the guard 10. The convex dome 36 remains exposed. It is preferred to place light padding beneath the pockets 4,6 to further absorb shock. A wrist wrap 9 is provided to maintain the position of the wrist portion 40 and to support the top surface of the wrist to prevent hyperextension during impact.

To those skilled in the art to which the present invention pertains, many widely varying embodiments and implementations of the principles of the present invention will be suggested from the foregoing. For instance, the size and dimensions of the guard are variable to protect, for instance, a child's hand. Slight variations in the curve are contemplated. In addition, the glove mounting means for the palm guard may be constructed from other materials and may be configured differently to hold the palm guard. The description and the disclosure present herein are by way of illustration only and should not be considered to limit the present invention, the scope of which is more particularly set forth in the following claims.

What is claimed is:

1. A palm guard for use with a sports glove comprising:

a molded, rigid, elongated unitary body with shock absorption properties, the body defining a wrist portion having an outer edge at a wrist area of a wearer and extending below the wrist to a contiguous arched palm portion, the arched palm portion defining a convex arch having an apex with a maximum thickness greater than a thickness of the wrist portion and a thickness of a remainder of the arched palm portion, the convex arch forming a space between the palm guard and a palm and a heel area of the hand, the arched palm portion extending to a second edge at least substantially at a mid-palm area of the hand, the shock absorption properties of the palm guard, together with the thickness of the apex and the space between the heel area and the palm guard, for absorbing and dissipating impact forces to the wrist, heel and palm of the hand caused by falls during sports activities.

2. The palm guard of claim 1 molded from a polyamide plastic material.

3. The palm guard of claim 1 wherein the second edge has a first thickness, the arched palm portion increasing in thickness, the convex arch defining a greatest thickness, the wrist portion decreasing in thickness to the outer edge having a third thickness.

4. The palm guard of claim 1 wherein the apex defines a height of substantially 1 inch.

5. An abbreviated glove for sports comprising:

a finger area;

a thumb area;

a top of the hand area;

a palm area having a guard mounting means attached thereto;

a palm guard for attachment to the mounting means, the palm guard comprising a molded, rigid, elongated unitary body with shock absorption properties, the body defining a wrist portion having an outer edge positioned at a wrist area of the glove and extending from above the wrist area to a contiguous arched palm portion, the arched palm portion defining a convex arch having an apex with a maximum thickness greater than a thickness of the wrist portion and a thickness of a remainder of the arched palm portion, the convex arch forming a space between the palm guard and a palm and a heel area of the hand, the arched palm portion extending to a second edge at least substantially at a mid-palm area of the glove, the shock absorption properties of the palm guard, together with the thickness of the apex and the space between the heel area and the palm guard, for absorbing and dissipating impact forces to the wrist, heel and palm of the hand caused by falls during sports activities; and a wrist wrap means for securing the position of the wrist portion.

6. The abbreviated glove of claim 5 made from an elastic material, the guard mounting means defining a pair of pockets for holding the palm guard.

7. The palm guard of claim 5 molded from a polyamide plastic material.

8. The palm guard of claim 5 wherein the outer edge has a first thickness, the arched palm portion increasing in thickness, the convex arch having a greatest thickness, the wrist portion decreasing in thickness to the second edge having a third thickness.

9. The palm guard of claim 5 wherein the convex arch defines an apex having a height of substantially 1 inch.

10. The sports glove of claim 5 further comprising padding beneath the pockets.

* * * * *

UNITED STATES PATENT AND TRADEMARK OFFICE

CERTIFICATE OF CORRECTION

PATENT NO. : 5,339,465

DATED : August 23, 1994

INVENTOR(S) : Ronald A. Kyewski

It is certified that error appears in the above-indentified patent and that said Letters Patent is hereby corrected as shown below:

On the title page, item [76] Inventor: "234 Bonita La., Foster City, Calif. 94404", change to read —243 Bonita Lane, Foster City, California 94404—.

Signed and Sealed this

Twenty-eighth Day of November 1995

*Attest:*

Bruce Lehman

BRUCE LEHMAN

*Attesting Officer*

*Commissioner of Patents and Trademarks*